US006041475A

United States Patent [19]

Nidelkoff

[11] Patent Number: 6,041,475

[45] **Date of Patent: *Mar. 28, 2000**

[54] LOCKING COUNTERBALANCE SHOE FOR TILTABLY REMOVABLE SASH WINDOWS

[75] Inventor: Michael J. Nidelkoff, White Bear Lake, Minn.

[73] Assignee: Intek Plastics, Inc., Hastings, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/861,620

[22] Filed: May 22, 1997

[51] Int. Cl.[7] ..... E05D 13/00

[52] U.S. Cl. ..... 16/193; 16/DIG. 16; 49/181

[58] Field of Search ..... 16/193, 197, 199, 16/DIG. 16; 49/181, 414, 419

[56] References Cited

U.S. PATENT DOCUMENTS

| | | | |
|---|---|---|---|
| 3,441,978 | 5/1969 | Perry | 16/193 |
| 4,363,190 | 12/1982 | Anerson | 49/181 |
| 5,027,557 | 7/1991 | May | 49/181 |
| 5,301,467 | 4/1994 | Schmidt et al. | 49/181 |
| 5,632,117 | 5/1997 | Prete et al. | 49/181 |

*Primary Examiner*—Chuck Mah

*Attorney, Agent, or Firm*—Merchant & Gould P.C.

[57] ABSTRACT

An automatic locking brake shoe device for a double sash window is disclosed which is slidably disposed in the guide channel of the window jamb liner. The brake shoe device interconnects with an associated sash through a laterally projecting sash pin. The automatic locking brake shoe device comprises first and second brake shoe members that are pivotally connected for relative pivotal movement. The first member is connected to the window balance mechanism, and the second member includes a locking member that engages the jamb liner when it is rotated to the locking position. A small spring disposed between the first and second members normally urges the second member into the locking position when the sash is removed. The sash pin engages the second member when the sash is in its sliding position causing the small spring to yield and to attract the second member from the locking position.

21 Claims, 5 Drawing Sheets

LOCKING COUNTERBALANCE SHOE FOR TILTABLY REMOVABLE SASH WINDOWS

BACKGROUND OF THE INVENTION

The invention is directed to an automatic locking device for double hung windows with removable sashes.

Double hung windows conventionally include a pair of vertically slidable window closures or sashes each of which is smaller than the rectangular window opening, but which together slide into an overlapping position in which the window opening is closed. Both sashes are slidable to open the window to varying degrees.

Each sash also conventionally slides relative to a pair of jamb liners that are installed on opposite sides of the window jamb, and which retain as well as slidably guide both sashes. Jamb liners are typically extruded from a plastic material that provides a relatively low frictional sliding surface and which remains relatively stable over a broad range of temperatures. The jamb liner may include some type of spring or biasing mechanism between the back side of the liner and the jamb side that urges the jamb liner into retaining contact with the side of the associated sash. See, for example, U.S. Pat. No. 5,265,308 issued Nov. 30, 1993 to Michael M. May.

Double hung windows also typically include some type of balance mechanism on each side, generally within the jamb liner itself, that counter balances the weight of the sash and enables it to be retained in a desired position. Generally, the balancing mechanism, which often comprises a coil spring, is connected to a force transfer device that is slidably disposed within a vertical channel within the jamb liner and which is also connected to the sash. The force transfer device may be constructed to frictionally slide within the jamb liner to assist in the overall balance of the sliding sashes, in which case it is referred to as a friction clutch or brake shoe. The sash typically includes a laterally projecting pin on each of its sides, and the pin projects into the jamb liner channel to mechanically interconnect with the brake shoe. As assembled, the sash, by virtue of its weight, exerts a downward force on the brake shoe, and the balance mechanism exerts an upward force on the brake shoe to maintain the sash in a desired position as well as to permit a smooth, counter balanced movement from position to position. The brake shoe may include an adjustment to vary the degree of friction with which it slides within the jamb liner to accomplish the desired balance.

Virtually all currently manufactured double hung windows are also constructed to permit the home owner to remove both sashes to gain access to the external glass panes for simplified cleaning. To accomplish this, the sash is laterally forced against one side of the associated jamb liner, which enables clearance and removal of the opposite side from its associated jamb liner. The sash may then be withdrawn from the window opening.

However, for many windows having removable sashes, a mechanism is provided to lock the brake shoes into a fixed position within the liner when the sash is removed since there is no longer a downward force on the brake shoe to counter balance the upward force of the balancing mechanism. In other words, unless the brake shoe is locked in place, it will immediately be pulled by the coil spring to the uppermost position within the jamb liner channel. This may damage the head jamb, the balance mechanism and/or the brake shoe and in any case leaves the brake shoe in an improper position (and perhaps inaccessible) for reinstallation of the sashes.

There are many automatically locking brake shoes currently available. One of the more popular locking brake shoes permits sash removal by tilting the sash inwardly from its top edge, pivoting relative to the bottom edge. This enables easy access to the outside surfaces of the glass panes within the sash for convenient cleaning. As the sash is tilted inward, it also rotates a mechanism within the brake shoe that causes a locking member to engage the channel sides of the jamb liner and retain the brake shoe in place. Such devices operate satisfactorily, although they typically require the sash to be tilted to a predetermined point before the locking mechanism is actuated, and this can be difficult to operate if the home owner does not understand the function and structure of the device. Further, the sash often must be precisely aligned with the brake shoe members on each side upon reinsertion, and it is sometimes difficult to accomplish this precise alignment simultaneously with both brake shoes.

Most conventional locking mechanisms also interact with the sash and/or balance mechanism in a specific manner which means that the brake shoe cannot be adapted to different sashes and/or different balance mechanisms. A brake shoe having more universal application would effect reductions in cost in a number of ways, including but not limited to manufacture, inventory, repair and replacement.

Another problem with conventional brake shoes having an automatic locking feature is that the locking feature may be actuated by the upward pull of the balance mechanism when the sash is removed. A problem created by such structural arrangements is that the balance mechanism is conventionally a coil spring, the force of which varies as a function of its displacement. As the sash is moved upwardly in its guided channel, the spring force decreases because the spring is stretched to a lesser degree. If this force diminishes to the point that it is less in magnitude than the resisting frictional force, the locking feature may not be actuated when the sash is fully tilted or removed.

The inventive counter balance mechanism, or brake shoe, was developed with the objective of overcoming these disadvantages. The inventive brake shoe consists of a two piece member, the first of which is a member that is slidably disposed in an associated jamb liner channel and which is adapted for connection to the counter balance coil spring. Preferably, the first member includes adjustment means for varying the degree of friction it has with the jamb liner channel.

The second member is pivotally connected to the first member and movable between a sliding position in which it does not engage the jamb liner channel side and a locking position in which a biting or locking edge rotates into locking engagement with the channel side. The second member is normally rotated into the locking position by a separate and independent locking spring. The second member is forced into its sliding position by the interlocking engagement of a sash pin carried by the sash side. The sash pin uniquely engages the brake shoe in a manner in which it seats in an interlocked position with the sash slidably disposed between the jamb liners, but in which it may be rotated out of this interlocked position when the sash is tilted inward. As soon as the sash begins inward tilting movement, the independent locking spring causes the second member to rotate relative to the first member to engage the jamb channel side and lock the brake shoe into place.

The inventive brake shoe solves a number of the problems encountered in prior art devices. The fact that it has an independently operating spring means that the locking mechanism will be fully actuated whether the sash is in a lower or upper position within the jamb. In either case, the force of the locking spring immediately initiates the locking mechanism as soon as the sash begins to be tilted inward. This occurs even if the sash is in an upper position and the coil spring of the balance mechanism generates very little force.

The independently operated locking spring also enables the brake shoe to be used in windows that vary in size, and to work effectively in windows of all sizes.

Further, because of the unique relationship of the sash pin to the brake shoe, the device operates effectively with a significant degree of forgiveness. For example, if for some reason the sash is removed in such a way that one side leaves its jamb liner at a different point than the opposite side, the brake shoes will nevertheless properly lock. Conversely, there is no particular alignment necessary on the part of the sash pins with the respective brake shoes. Because of the unique construction and operation of the brake shoe, the sash pin may enter the brake shoe either as the window is tilted back into position or as the sash pin engages the brake shoe by vertically sliding from above. This will be accomplished even though the brake shoes on each side of the jamb lock at different elevations within the jamb liner.

Further, the inventive brake shoe includes an interlocking feature that prevents the sash pin from being vertically raised once it has been interlockably seated. This means that the sash pin will not become separated from the brake shoe during any phase of sliding operation of the sash.

The invention will be more fully appreciated from the appended drawings and the following description.

DETAILED DESCRIPTION OF THE PREFERRED EMBODIMENT

Figure 1:
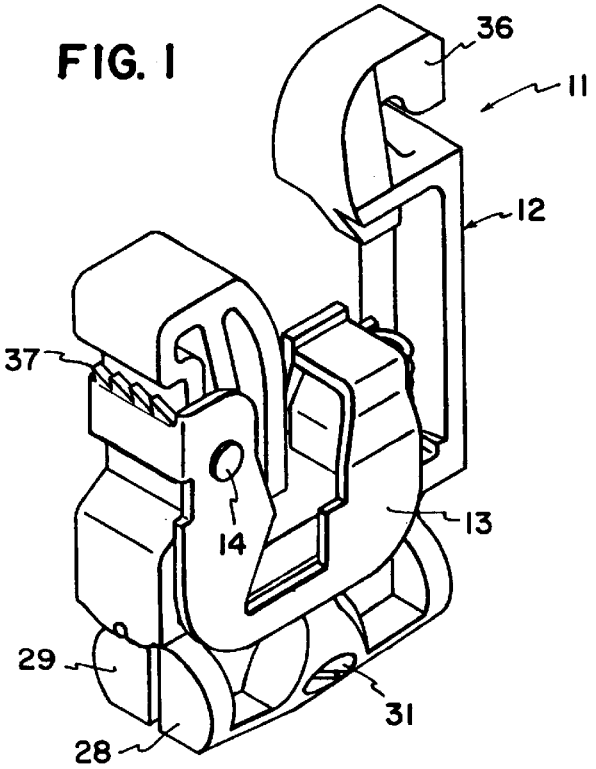
FIG. 1 is a perspective view of a locking counterbalance shoe embodying the invention and intended for use in the jamb liner of a double hung window.

With initial reference to FIG. 1, an automatic locking device for double hung windows with removable sashes bears general reference numeral 11. The automatic locking device 11 preferably incorporates an adjustable friction feature, and with this feature, the device 11 will be referred to throughout as a brake shoe. Brake shoe 11 comprises first and second members 12, 13 that are pivotally connected by a drive pin 14.

Figure 3:
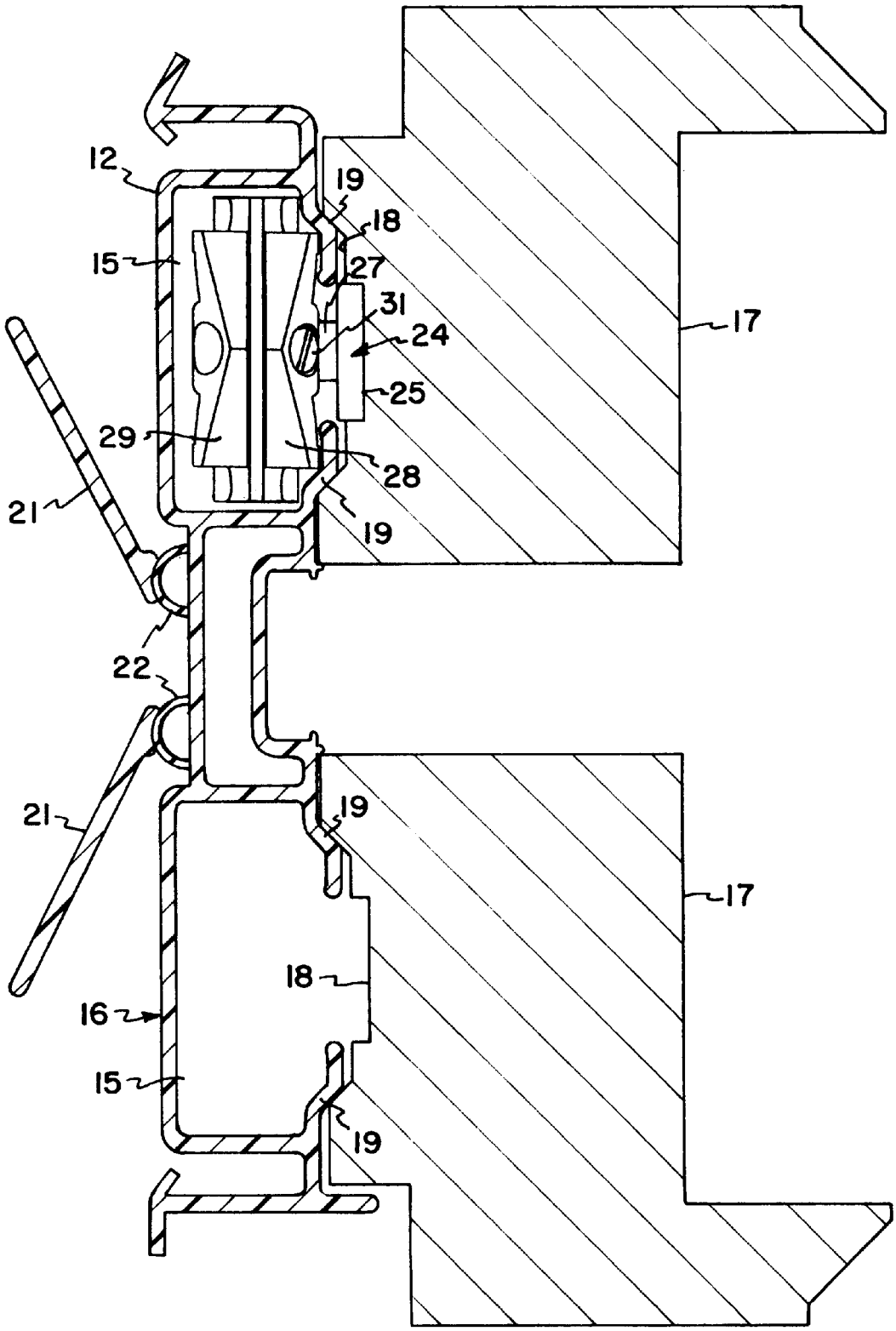
FIG. 3 is a bottom view of the jamb liner and locking counterbalance shoe as interconnected to the slidable sash.

With additional reference to FIG. 3, brake shoe 11 is sized and constructed for disposal in duplicate side by side channels 15 of a plastic extruded jamb liner bearing the general reference numeral 16. Jamb liner 16 is of the type disclosed in commonly owned U.S. Pat. No. 5,265,308, which issued Nov. 30, 1993. Jamb liner 16 is sized and constructed to fit into the side jambs of a window (not shown), typically a double hung window having a pair of vertically slidable window members or sashes 17. In the embodiment shown, each side of each of the sashes 17 is formed with a vertically disposed longitudinal channel or plow 18, and jamb liner 16 includes vertically disposed, longitudinally extruded angular portions 19 which extend into and engage the respective sash plows 18. Other configurations may be used between the sash and jamb liner.

Jamb liner 16 also includes a pair of rearwardly projecting angular hinge members 21 that are secured to the main body of jamb liner 16 by generally semi-circular spring members 22 that are formed from a resilient plastic material. As disclosed in U.S. Pat. No. 5,265,308, the hinge members 21 are compressed against the window jamb when the jamb liner 16 is installed, urging the jamb liner 16 laterally away from the jamb into a spring loaded engagement with the respective sashes 17. With jamb liners 16 disposed on each side of the jamb, the sashes are guided by and slide relative to the angular protrusions 19.

Although the inventive brake shoe is shown in use with a spring loaded jamb liner, it may also be successfully used with non-compression jamb liners.

As is well known in the art, each of the sashes 17 may be removed by forcing it laterally in compression against one of the spring biased jamb liners 16, releasing the opposite side of the sash 17 and enabling it to be withdrawn from the window opening.

In the inserted slidable position, each of the sashes 17 is partially retained in a given position by friction between the jamb liners 16 and the sides of sashes 17. However, based on weight of the sash 17 and coupled with the fact that it is to be smoothly slidable relative to the jamb liners 16, double hung windows conventionally include a balance mechanism the broad purpose of which is to create an upward force on the sash that counterbalances the sash weight taking frictional forces into consideration. There are many types of balance mechanisms commercially available, but one of the more common is the type disclosed in FIGS. 4 and 5; viz., a longitudinal coil spring 23 the upper end of which is secured to the top of jamb liner 16 by a spring clip (not shown) or other suitable connector, with the lower end secured to brake shoe 11 in a manner disclosed in further detail below.

With reference to FIG. 3, each of the sashes 17 is provided with a pair of sash pin members 24 (only one of which is shown in this Figure), each of which is disposed in the plow 18 toward the bottom of the sash 17. Sash pin member 24 is specifically shown in FIGS. 5–8. It includes a small rectangular flat plate 25 sized to fit into the sash plow 18 and including a pair of counter sunk holes 26 to received mounting screws for this purpose.

Projecting forwardly from the bottom face of plate 25 is a sash pin 27, which is of rectangular cross section having a predetermined width and thickness. At the extreme end of sash pin 27 is a retainer portion 27*a* having a slightly enlarged width relative to the sash pin 27. Sash pin member 24 is preferably cast from steel.

As shown in FIG. 3, sash pin 27 projects beyond the sash plow 18 and into the channel 15 of jamb liner 16. Conventionally, each sash pin 27 engages the associated brake shoe 11 in the jamb liner channel in a manner so that each of the sashes 17 is connected to each of the opposed balance mechanisms. The manner in which sash pin 27 interconnects with brake shoe 11 will be described in further detail below.

Figure 2:
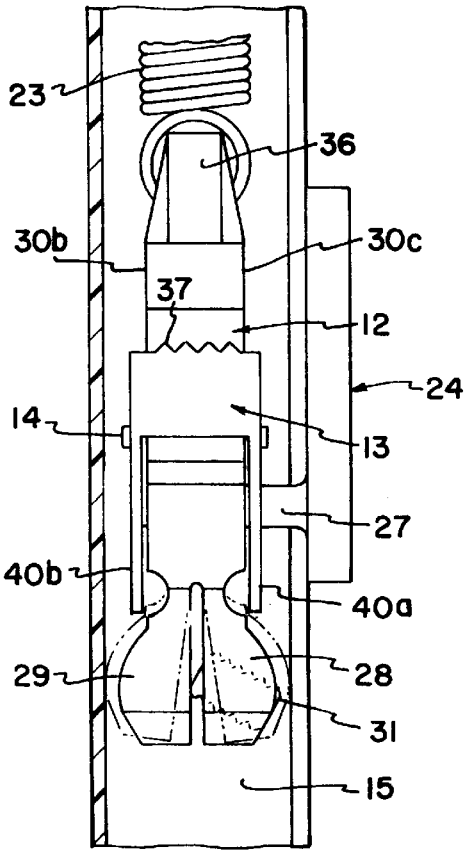
FIG. 2 is a side elevation of the locking counter balance shoe slidably disposed in a jamb liner.

With reference to FIG. 1, first member 12 of brake shoe 11 is an irregularly shaped member having a width that is slightly less than the width of jamb liner channel 15. First member 12 is preferably injection molded from a plastic material having a relatively low coefficient of friction (e.g., Acetal), enabling it to slide vertically upward and downward within channel 15. As best shown in FIGS. 1 and 2 the thickness and depth of first member 12 generally corresponds to the depth of channel 15. However, its lower end is molded with bifurcated legs 28, 29 the lower ends of which respectively frictionally engage the front and back inner surfaces of channel 15. The degree of frictional contact is controlled by an adjustment screw 31 that is threadably carried in the extreme lower portion of either of the bifurcated legs 28, 29 and the end of which bears against the opposite bifurcated legs 28, 29. Adjustment screw 31 is placed in the leg 28 for use in the left side of jamb liner 16, and in the leg 29 for right-hand use. Adjustment screw 31 is angularly disposed with the slotted screw head disposed angularly inward and below the associated sash 17. As such, adjustment screw 31 is accessible from below the sash 17, without removing it, through the opening of channel 15 when the associated sash 17 is raised, enabling its adjustment and hence the amount of frictional contact of brake shoe 17 with the front and back inner surfaces of channel 15.

With continued reference to FIGS. 1 and 2, first member 12 is formed with substantially planar front and rear faces 30*a*, 30*b*, with the exception of the extreme lower end of bifurcated legs 28, 29 which project outwardly into sliding engagement with the sides of channel 15. When viewed from the side, as for example in FIG. 4, first member 12 has a planar surface 32 on the right side and coplanar surfaces 33, 34 on the left side between which a recess 35 is formed. The upper right side as viewed in FIG. 3 terminates in a hook 36 that is adapted to receive the lower end of coil spring 23. Based on the upward projection of the right and left sides of the first member 12, it generally has a U-shaped configuration when viewed in the side elevation of FIG. 4. The left side is also formed with a downwardly projecting cantilevered finger 39, the purpose of which will be discussed in further detail below.

Figure 4:
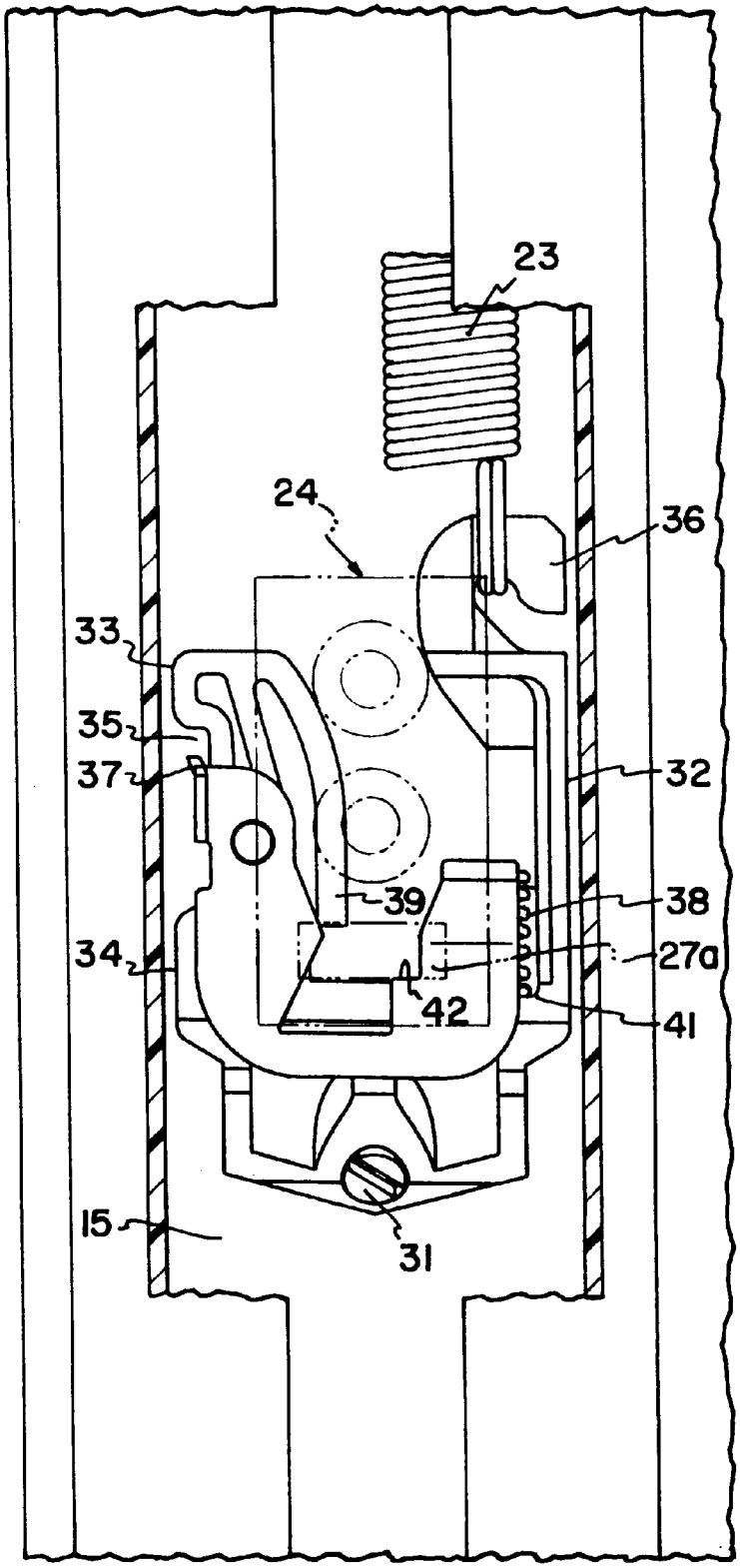
FIG. 4 is a fragmentary view and side elevation of the jamb liner and locking counterbalance shoe in a sliding mode of operation, portions thereof being broken away and shown in section.

Second member 13 is a metal stamping that is also generally of U-shaped configuration. As viewed in FIG. 4, its upwardly projecting left side is the one pivotally connected to the first member 12 with the drive pin 14. The upper left side terminates in a sharp serrated locking edge 37 which is withdrawn into the recess 35 with the brake shoe 11 in its sliding mode of operation, as shown in FIG. 4. In the locking mode shown in FIG. 5, in which the second member 13 is pivoted in a counter clockwise direction relative to the first member 12, the serrated edge 37 projects beyond the recess 35 and bites into the inner surface of the jamb liner channel 15, the effect of which is to lock the brake shoe 11 into a fixed position relative to the jamb liner 16.

Figure 5:
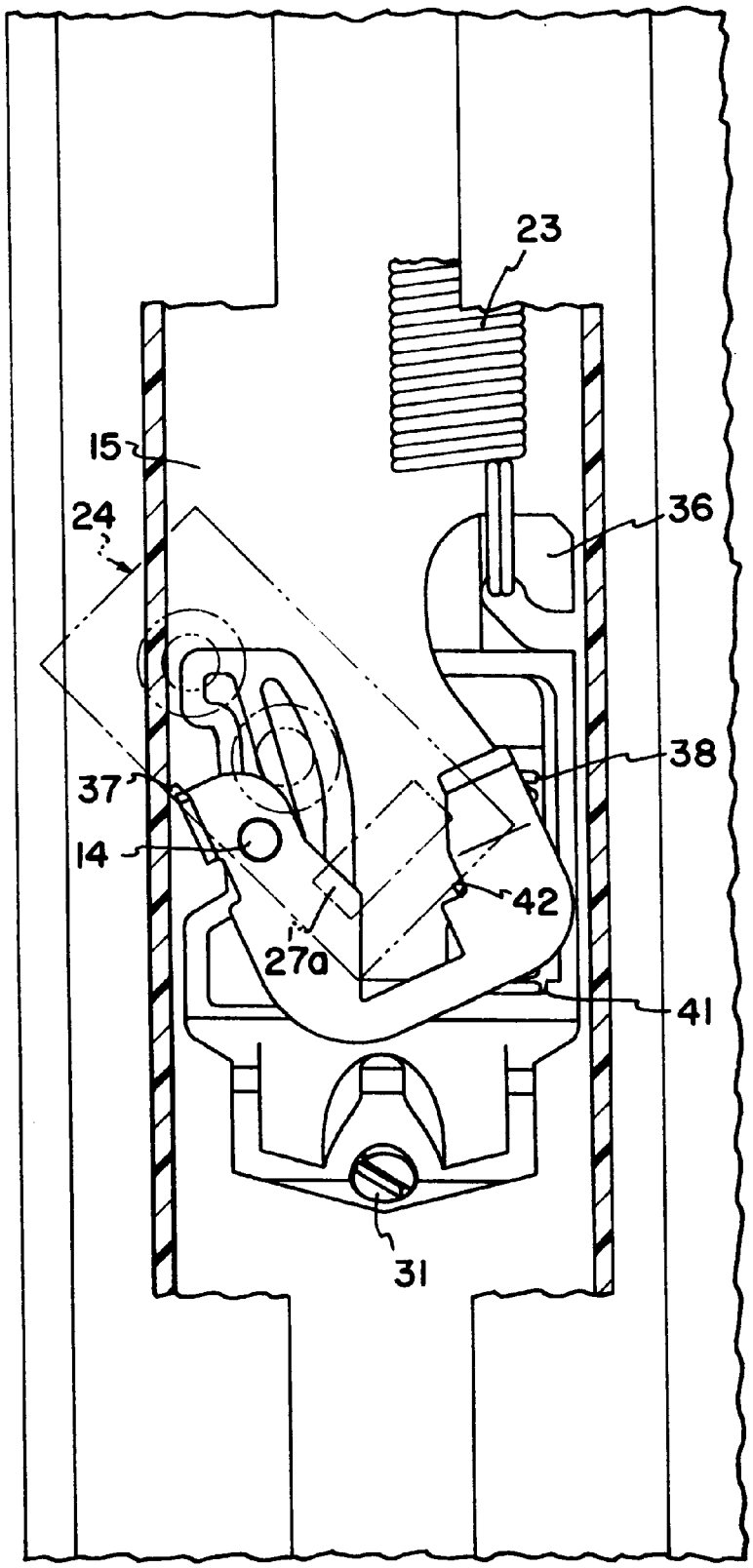
FIG. 5 is a view similar to FIG. 4 with the locking counterbalance shoe in a locking mode of operation.
Figure 6:
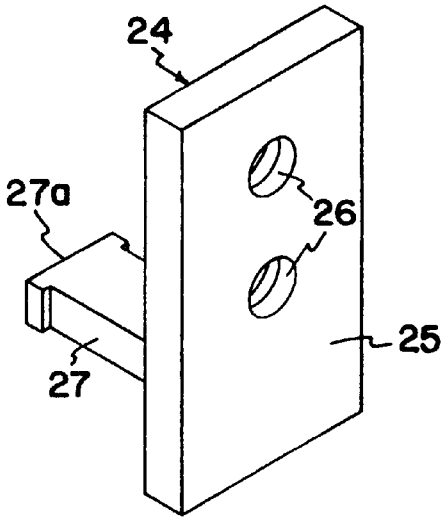
FIG. 6 is a perspective view of a sash pin usable with the locking counterbalance shoe.
Figure 7:
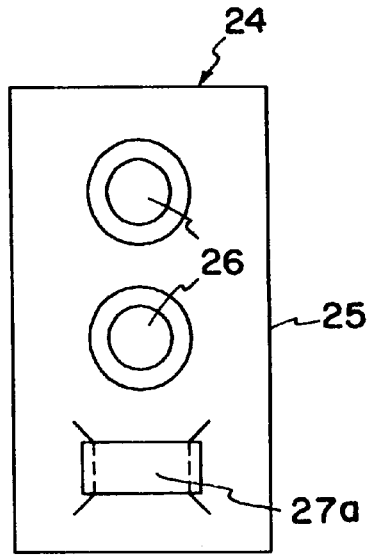
FIG. 7 is a front elevational view of the sash pin.
Figure 8:
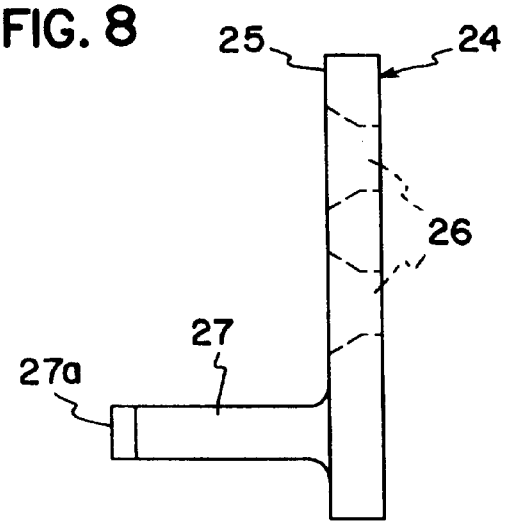
FIG. 8 is a side elevational view of the sash pin.
Figure 9:
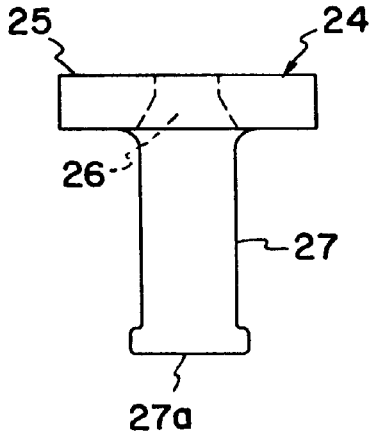
FIG. 9 is a top plan view of the sash pin.

The pivoting movement of second member 13 between the positions shown in FIGS. 4 and 5 is guided to some extent by the fact that it is formed by spaced sides 40*a*, 40*b* the inner surfaces of which are guided by the front and rear planar faces 30*a*, 30*b* of the first member 12. This facilitates pivotal movement of the second member 13.

Second member 13 is normally biased to the locking position shown in FIG. 5 by a small coil spring 38 that is disposed between a ledge 41 on the right side of the base of the U-shaped configuration first member 12 and the inner top surface of the right side of second member 13. As such, in the absence of a downward force on second member 13 as discussed below, brake shoe 11 is locked into the position shown in FIG. 5.

The downward force necessary to rotate second member 13 clockwise into the sash sliding position shown in FIG. 4 is the weight of the sash itself acting through the sash pin 24. As shown in FIGS. 4 and 5, the right side of the base of second member 13 is formed with a small notch or ledge 42 that is sized to receive the main or shank portion of the sash pin 27. As best shown in FIG. 3, when the sash pin 27 interlocks with the brake shoe 11, the retainer or head portion 27*a* projects into the space defined between the spaced sides 40*a*, 40*b* of the second member 13. This space provides some degree of lateral tolerance as the sash pin enters into this interlocking engagement. When the sash pin 27 is seated on the ledge 42, the retainer portion 27*a* prevents pin 27 from being withdrawn from the second member 13. It has been found that the inclusion of the retaining portion 27*a* significantly helps resisting the wind load on the windows of sashes 17 when they are in the normal sliding position of FIG. 4.

The structural cooperation between the sash pins 24 and their associated brake shoes 11 permits each of the sashes 17 to be pivoted or tilted inward for easy removal and cleaning. With reference to FIGS. 4 and 5, the sash pin 27 is represented by phantom lines and also indicates the position of the sash, which is not shown for clarity. As shown in FIG. 4, when the sash 17 is in its normal sliding position sash pin 27 is flatly seated on the ledge 42 of the second member 13. It will be noted that in this flat position, the sash pin 27 is locked in place by the cantilevered finger 39, which prevents sash pin 27 from being lifted vertically upward from this position. As discussed below, sash pin 27 may enter this position due to the resilient nature of the cantilevered finger 39, which is laterally deflected as sash pin 27 moves toward the ledge 42. When sash pin 27 reaches the position shown in FIG. 4, cantilevered finger 39 springs back to its normal position and sash pin 27 is locked in place. As discussed below, sash pin 27 may be rotated counter clockwise out of this position to escape the locking engagement of cantilevered finger 39.

Specifically, as the sash 17 is tilted inward (i.e., to the left as viewed in FIGS. 4 and 5), sash pin 27 begins to rotate in a counter clockwise direction at which point it leaves the ledge 42. When in the position of FIG. 5, sash pin 27 has rotated to the point of moving past cantilevered finger 39 and clearing the second member 13, and the sash 17 can now be removed from the window frame in its entirety or left in the tilted position to provide access to the external surfaces of the glass panes for cleaning.

In either case, when sash pin 27 leaves the ledge 42, the forces maintaining the second member 13 in the position shown in FIG. 4 are no longer present. When this occurs, the small coil spring 38 imposes an upward force on the right under side of the second member 13, causing it to pivot in a counter clockwise direction about pivot pin 14. This in turn causes the serrated edge 37 to bite into the inner surface of channel 15, thus locking brake shoe 11 in place. This prevents the brake shoe 11 from accelerating upwardly in the channel 15 as soon as the sash 17 is removed.

The brake shoe 11 is typically installed at the time the jamb liner 16 is fabricated and assembled. A brake shoe 11 is installed by first connecting the upper end of the coil spring 23 to the upper end of the channel 15 through the use of a conventional clip. The brake shoe 11 is then pulled downward in the associated channel 15. In order for this to happen, the second member 13 must be manually rotated in a clockwise direction to the position shown in FIG. 4 to cause the serrated locking edge 37 to be pivoted away from the side of channel 15. Brake shoe 11 can now be pulled downward into the channel 15 against the spring force of coil spring 23 to an appropriate point, at which time the second member 13 can be released. Small locking spring 38 causes the second member 13 to pivot until the serrated locking edge 37 engages the side of channel 15, at which point the brake shoe 11 is locked in place.

With jamb liners 16 mounted in the opposed window jambs, the sashes 17 may be inserted into the window opening. As indicated above, each of the sashes 17 has a sash pin member 24 disposed in each of its opposed plows 18 along the lower edge thereof. When a sash 17 is inserted into the associated window opening, one side is pressed against its associated jamb liner 16, compressing it against the bias of the spring hinge members 21. The opposite side of the sash is then compressibly pressed against the opposite jamb liner 16 so that each of the plows 18 guidably slides along the angular protrusions 19 of the associated jamb liner 16.

With the sash pins 27 projecting into the respective channels 15, the sash 17 is lowered until each sash pin 24 engages the second member 13 of the associated brake shoe 11. This causes the second member 13 to move in a clockwise direction, in turn causing the serrated biting edge 37 to withdraw from the side of channel 15. As sash pin 27 moves downward toward the position shown in FIG. 4, it engages the cantilevered finger 39, laterally deflecting it and enabling the sash pin 27 to reach the ledge 42. At this point, cantilevered finger 39 returns to its normal or nonbiased position overlying sash pin 27 and locking it in place. In this position, the sash 17 and brake shoe 11 are interlocked, and brake shoe 11 is free to slide up and down within channel 15. With the brake show 11 and sash 17 interlocked, the upward force of spring 23 counterbalances the weight of sash 17, taking into consideration the frictional forces between the window sides and the jamb liner 16. As such, the window can be slidably moved to and retained in any position within the window opening. The degree of friction between brake shoe 11 and the front and back surfaces of channel 15 can be adjusted with adjustment screw 31 as described above.

Brake shoe 11 continues to guidably slide within channel 15 so long as the associated sash 17 is in place. If it is desired to remove the sash 17 (e.g., to clean the otherwise nonaccessible outer glass panes), one of the sash sides is compressed against its associated jamb liner 16 against the bias of the spring hinge members 21, releasing the opposite sash side from its associated jamb liner 16. The sash 17 may now be tilted inward from the window opening, which in turn causes each sash pin 27 to be pivotally rotated from the ledge 39 and to escape the locking engagement of cantilevered finger 39. This enables the small coil spring 38 to force serrated biting edge 37 into locking engagement with the side of channel 15. Brake shoe 11 will remain in this locked position until the sash is reinstalled as described above with the sash pin 27 being reinserted into its seat on ledge 39 to release the automatic lock.

The use of a separate and independently operating spring 38 to rotate the second member 13 is highly advantageous. As soon as the sash pin 27 begins to rotate from its seated position, the coil spring 38 moves the serrated edge 37 into locking engagement with the associated jamb liner, regardless of the position of the sash 17 within the window. This locking can occur with as little as 15° of rotation or tilt of the sash, insuring that the brake shoe 11 will be in a firmly locked position when the sash 17 is further tilted or entirely removed.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An automatic locking device for use with a window slidably disposed within guide channels defined within opposed window jamb liners at least one of which has a balance mechanism associated therewith, the automatic locking device being disposable with said balance mechanism in said one channel and comprising:

engagement pin means adapted for connection to a window side and constructed and arranged to project laterally into one of said channels when so connected;

a first member sized and constructed to slide in said channel, the first member comprising connecting point means adapted for connection to said balance mechanism;

a second member pivotally connected to and pivotally moveable relative to the first member between sliding and locking positions, the second member comprising:

seat means for said engagement pin means constructed and arranged to engageably receive the engagement pin means and to be pivoted thereby to said sliding position; and jamb liner engaging locking means constructed and disposed to project externally of the automatic locking device to lockably engage the jamb liner with the second member pivoted to its locking position, and to retract from engagement with the jamb liner with the second member pivoted to its sliding position;

and biasing means disposed between the first and second members for normally urging the second member into said locking position, the biasing means being constructed and arranged to yield to the presence of said engagement pin means and thereby to permit movement of the second member to the sliding position.

2. The locking device defined by claim 1, wherein the jamb liner engaging locking means comprises a locking edge formed on one side of the second member.

3. The locking device defined by claim 2, wherein the biasing means is disposed between the first and second members on the side of said pivotal connection opposite said locking edge.

4. The locking device defined by claim 3, wherein the biasing means comprises a coil spring compressibly disposed between the first and second members.

5. The locking device defined by claim 1, wherein the first and second members are of generally U-shaped configuration, the second member being formed from spaced sides dimension to receive the first member therebetween.

6. The locking device defined by claim 5, wherein the seat means of the second member is disposed at the base of said U-shaped configuration.

7. The locking device defined by claim 5, wherein the engagement pin means comprises a pin having an enlarged head portion disposed at its distal end, the enlarged head portion being sized and arranged to lie transversally between the spaced sides of said second member and to be retained therebetween when the second member is in its sliding position.

8. The locking device defined by claim 1, which further comprises adjustable friction means for varying the amount of frictional drag between the automatic locking device and the associated jamb liner channel.

9. The locking device defined by claim 8, wherein the adjustable friction means is disposed on said first member.

10. The locking device defined by claim 9, wherein the adjustable friction means comprises first and second spaced, laterally flexible leg members, each of which is formed with a transverse threaded bore therethrough, and an adjustment screw disposed in the threaded bore of one of said leg members, the bores and screw being disposed so that the screw adjustably bears against the other of said leg members to cause it to laterally flex to a desired degree.

11. The locking device defined by claim 1, which further comprises interlocking means for preventing the engagement pin means from being lifted laterally from the seat means when the second member is in said sliding position.

12. The locking device defined by claim 11, wherein the interlocking means comprises resiliently deflectable finger means disposed on the first member at least a portion of which normally overlies the seat means, the finger means being constructed and arranged to be deflected from its normal position by the engagement pin means as it enters the seat means and to return to its interlocking position when the engagement pin means is seated and the second member is in its sliding position.

13. The locking device defined by claim 11, wherein the engagement pin means comprises a pin of non-circular configuration with its longer dimension substantially horizontal with the second member in its sliding position.

14. The locking device defined by claim 13, wherein the finger means comprises a substantially vertically disposed cantilevered finger member the lower free end of which overlies a portion of said seat means.

15. An automatic locking device for use with a window slidably disposed within guide channels defined within opposed window jamb liners at least one of which has a balance mechanism associated therewith, the automatic locking device being disposable with said balance mechanism in said one channel and comprising:

engagement pin means adapted for connection to a window side and constructed and arranged to project laterally into one of said channels when so connected;

a first member sized and constructed to slide in said channel, the first member comprising connecting point means adapted for connection to said balance mechanism;

a second member pivotally connected to and pivotally moveable relative to the first member between sliding and locking positions, the second member comprising:

seat means for said engagement pin means constructed and arranged to engageably receive the engagement pin means and to be pivoted thereby to said sliding position; and jamb liner engaging locking means constructed and disposed to project externally of the automatic locking device to lockably engage the jamb liner with the second member pivoted to its locking position, and to retract from engagement with the jamb liner with the second member pivoted to its sliding position;

biasing means for normally urging the second member into said locking position, the biasing means being constructed and arranged to yield to the presence of said engagement pin means and to be pivoted to said sliding position thereby; and interlocking means for preventing the engagement pin from being lifted vertically from the seat means when the second member is in said sliding position.

16. The locking device defined by claim 15, wherein the interlocking means comprises resiliently deflectable finger means disposed on the first member at least a portion of which normally overlies the seat means, the finger means being constructed and arranged to be deflected from its normal position by the engagement pin means as it enters the seat means and to return to its normal interlocking position when the engagement pin means is seated and the second member is in its sliding position.

17. The locking device defined by claim 16, wherein the engagement pin means comprises a pin of non-circular configuration with its larger dimension substantially horizontal with the second member in its sliding position.

18. The locking device defined by claim 17, wherein the finger means comprises a substantially vertically disposed cantilevered finger member the lower free end of which overlies a portion of said seat means.

19. The locking device defined by claim 18, wherein the engagement pin means is disposed for abuttable engagement with the lower free end of the finger member when the second member is its sliding position to prevent being vertically lifted therefrom, the engagement pin means being rotatable away from said cantilevered finger member to escape said seat means.

20. The locking device defined by claim 19, wherein the non-circular engagement pin has a rectangular cross section.

21. The locking device defined by claim 15, wherein the biasing means is disposed between the first and second members.

* * * * *